US006705049B2

(12) United States Patent
Esmond et al.

(10) Patent No.: US 6,705,049 B2
(45) Date of Patent: Mar. 16, 2004

(54) RAIN AND STORM WATER FILTRATION SYSTEMS

(76) Inventors: Steven E. Esmond, 3627 W. Park Central, Orange, CA (US) 92868; Larry Quinn, 18612 Saugus Ave., Santa Ana, CA (US) 92705; Robert K. Weir, 2390 Forest St., Denver, CO (US) 80207

( * ) Notice: Subject to any disclaimer, the term of this patent is extended or adjusted under 35 U.S.C. 154(b) by 61 days.

(21) Appl. No.: 10/094,163

(22) Filed: Mar. 8, 2002

(65) Prior Publication Data

US 2003/0167700 A1 Sep. 11, 2003

(51) Int. Cl.[7] ..... E04D 13/08; E02B 5/08

(52) U.S. Cl. ..... 52/16; 210/154; 210/162; 210/163

(58) Field of Search ..... 52/16, 12; 210/154, 210/162, 163

(56) References Cited

U.S. PATENT DOCUMENTS

| | | | | |
|---|---|---|---|---|
| 1,552,902 | A | * | 9/1925 | Werner |
| 2,090,997 | A | * | 8/1937 | French |
| 2,419,501 | A | * | 4/1947 | Pinto |
| 3,628,668 | A | * | 12/1971 | Huppert |
| 4,415,462 | A | | 11/1983 | Finch et al. |
| 4,472,274 | A | * | 9/1984 | Williams |
| 4,801,377 | A | | 1/1989 | Bolt |
| 5,354,467 | A | * | 10/1994 | Moorhead |
| 5,405,539 | A | * | 4/1995 | Schneider |
| 5,452,546 | A | * | 9/1995 | Goddard |
| 5,709,051 | A | * | 1/1998 | Mazziotti |
| 5,985,158 | A | * | 11/1999 | Tiderington |
| 6,190,545 | B1 | * | 2/2001 | Williamson |
| 2002/0175120 | A1 | * | 11/2002 | Norell et al. |

FOREIGN PATENT DOCUMENTS

| | | | | |
|---|---|---|---|---|
| DE | 43 21 408 | A1 | * 1/1995 | ..... E04D/13/08 |
| DE | 44 28 969 | A1 | * 2/1995 | ..... E04D/13/08 |

OTHER PUBLICATIONS 1 sheet of "Products" from www.hydroscreen.com describing Coanda effect screens. No Date.*
1 sheet from www.norrisscreen.com/applications. No date.*
Internet Paper: Avlis Products, Inc., "The W–103 Wedge® Downspout Screen," www.avlis.com/wedge/main.htm.
Wahl, T., "Hydraulic Performance of Coanda–Effect Screens," Journal of Hydraulic Engineering, vol. 127, No. 6., pp. 1–16, Jun. 2001.

* cited by examiner

*Primary Examiner*—Robert Canfield
(74) *Attorney, Agent, or Firm*—Christie, Parker & Hale, LLP

(57) ABSTRACT

A debris-filtering downspout and other water runoff conduits and receptacles are disclosed, and include a Coanda screen mounted within a conduit, a culvert, a storm water conveyance or secured to a water collection basin. The Coanda screen provides high water throughput and is self-cleaning while effectively filtering debris contained in an incoming water stream.

29 Claims, 7 Drawing Sheets

Detail B

Detail A

Section A - A

RAIN AND STORM WATER FILTRATION SYSTEMS

The rain and storm water filtration systems discussed herein relate to filtration systems that employ screens to filter debris and other unwanted material from water streams and, more specifically, to filtration systems having a Coanda screen for filtering water streams.

BACKGROUND OF THE INVENTION

Rainwater downspouts, curbside storm water runoff collectors, and similar water conduits share a common purpose: removal of water from where it is undesired, be it the roof of a building, a city street, a storm basin, or the like. All such conduits allow a volume of water to pass therethrough. Leaf litter, sand, dirt, grit, and other debris can accumulate within such conduits and clog them, rendering them ineffective. Equally bad, the poor design of many water conduits allows debris to pass through to downstream channels and, ultimately, the ocean, with a consequent negative environmental impact.

Not surprisingly, much effort and money has been spent devising ways to avoid clogged water conduits and contaminated water streams. Patents have been granted for inventions designed to filter water at curbside storm drains (U.S. Pat. No. 6,231,758 to Morris et al.), to treat water in a horizontal passageway (U.S. Pat. No. 6,190,545 to Williamson), to create temporary stream filtration systems (U.S. Pat. No. 4,297,219 to Kirk et al.), to remove downspout debris (U.S. Pat. No. 5,985,158 to Tiderington), and to shield rain gutters on the eaves of a building (U.S. Pat. No. 4,435,925 to Jefferys).

However, with respect to downspouts and storm water systems, the prior art has several shortcomings. Among other things, it is difficult to devise a system that both operates under high flow and effectively filters out small particulate matter and other debris. This is because a filter element that accommodates large flow must also be designed with large spacing to suit the large flow. However, large spacing allows medium to small particulates and waste to pass through unfiltered. Conversely, a filter element designed to trap small particulate matter typically obstructs flow. An ideal water runoff filter would be both capable of passing high flow therethrough and removing small waste and debris.

Accordingly, there remains a need for a filter system for removing debris from a water stream using a filter element that is amenable to high volume flow, capable of removing or trapping waste the size of or even smaller than the size of the gap used for the filter and, preferably, self-cleaning.

SUMMARY OF THE INVENTION

The present invention integrates a Coanda screen (sometimes called "Coanda-effect" screen) into water collection systems such as downspouts, storm runoff collectors, sewer drains, and similar conduits and receptacles. An exemplary embodiment includes retrofitting an existing downspout section (or customizing a new downspout section) with a Coanda screen to provide a downspout with a highly efficient filter for removing debris from a stream of water. Depending on the water flow rate and the size of the debris encountered, different screen sizes and different screen mounting angles maybe selected to accommodate the same. Filtered water can pass through the screen, while debris is retained by the Coanda screen and then collected in an optional retaining basket.

In another embodiment, a curbside inlet to a storm drain is fitted with a Coanda screen. The screen is mounted between a raw inlet basin and an outlet basin. Filtered water is allowed to pass over the screen and then fall through the screen into the outlet basin, which then flows onward via an outlet pipe. Captured debris and waste are allowed to fall into a retention basin. To remove waste and debris more effectively, a retaining basket is used. When full, the basket can be lifted out of the curbside inlet and emptied.

BRIEF DESCRIPTION OF THE DRAWINGS

These and other features of the invention will be better understood when considered in conjunction with the accompanying drawings, wherein like part numbers denote like or similar elements and features, and wherein.

DETAILED DESCRIPTION OF THE INVENTION

Figure 1:
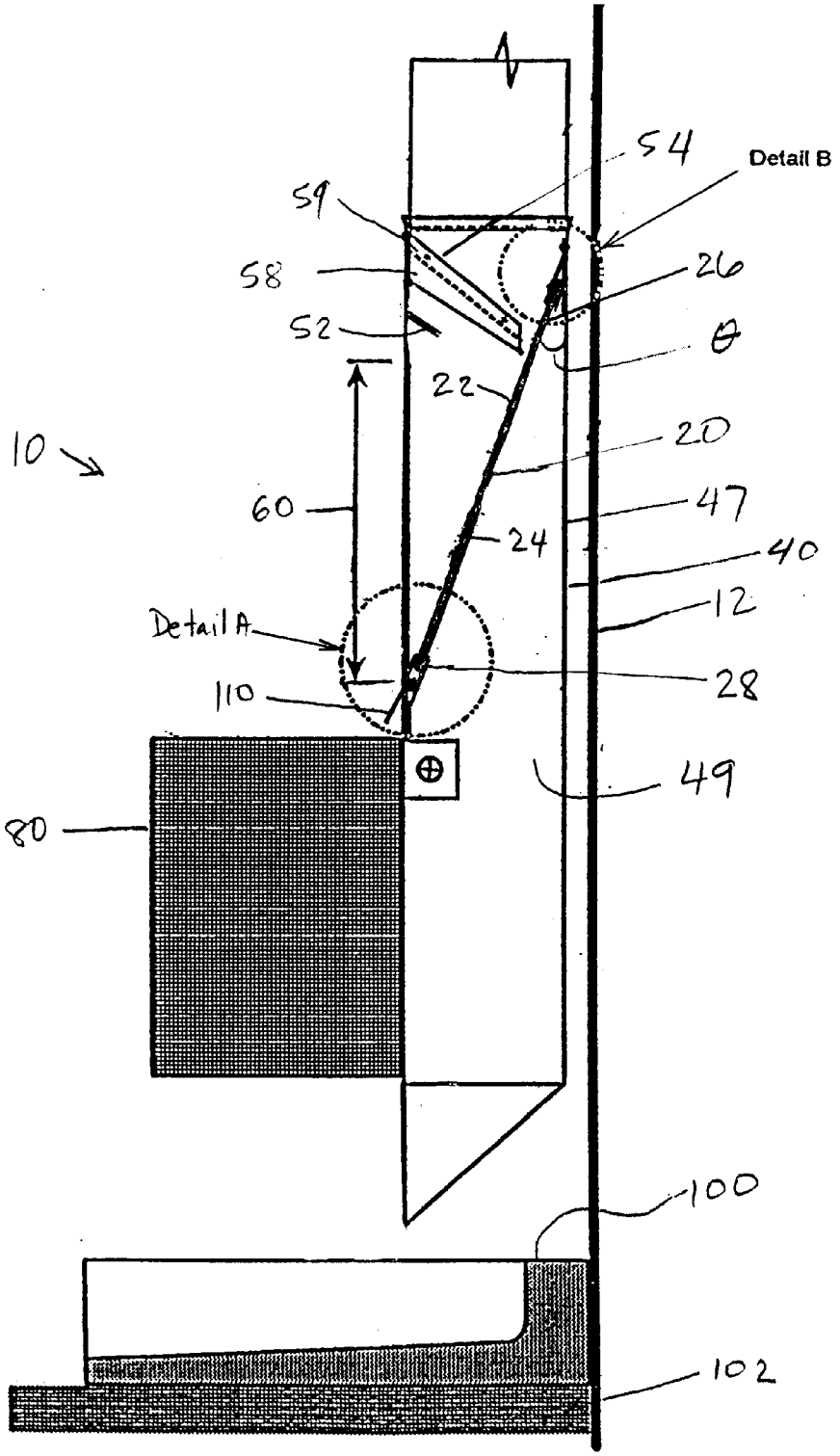
FIG. 1 is a side elevation view of a downspout with a Coanda screen in accordance with practice of the present invention.

In accordance with the present invention, a highly effective filter system for a rain water downspout, sewer inlet, curbside storm water drain, or similar water runoff conduit or receptacle is provided. A preferred embodiment of an improved downspout 10 is shown in FIG. 1. The downspout is mounted to an exterior wall 12 of a building by conventional mounting means (not shown), such as welds, adhesives (e.g., glue, cement, mortar, etc.), mechanical fasteners (e.g., rivets, bolts, screws, clamps, bands, straps, etc.), and other means known in the art. The downspout 10 includes a Coanda screen 20 mounted within a portion 40 of the downspout, referred to herein as the "upgraded downspout portion" or "upgraded downspout section". The screen is accessible via a downspout opening 60 in the upgraded downspout portion. Water that flows into the downspout from a gutter (not shown) is filtered as it passes through the Coanda screen. Debris caught by the screen can slide out of the downspout opening into an optional retaining basket 80 mounted outside of and below the downspout opening. Effluent from the downspout empties into a splash guard or basin 100 which, preferably, is seated on a concrete slab 102. Alternatively, the downstream end of the downspout is coupled to an underground header or a drain line (not shown) running to a main sewer or storm drain. The Coanda screen, upgraded downspout portion, retaining basket, and other features are described below in more detail.

An existing downspout can be upgraded or retrofitted by cutting out or otherwise removing a portion thereof, and installing an upgraded downspout portion or section 40 therein, using a slip joint, welds, adhesives, mechanical fasteners, or other conventional attachment means. Alternatively, an entire downspout can be fabricated as such and installed as part of a rain water removal system that includes one or more gutters and mounting hardware. In either case, the improved downspout provides a path for funneling water from a roof (or a deck, mezzanine, or other surface) to grade (e.g., street level) or to a storm water runoff drain or a main sewer line. Effluent from the downspout eventually flows to a storm drain or sewer system and then to the ocean, in some cases via a water treatment facility.

The downspout 10 is preferably constructed of stainless steel, galvanized steel, aluminum, plastic, or some other durable and water-resistant material, and has an interior and an exterior, and a cross-sectional shape that is generally rectangular. Alternatively, the downspout can have a generally circular cross-section or other desired geometry. In an exemplary embodiment, the downspout 10 is physically attached to an exterior wall 12 of a house or a building by any conventional means, such as downspout bands (not shown) anchored to the exterior wall. Water falling into the downspout passes into the upgraded downspout section 40 to the Coanda screen 20. The Coanda screen 20 allows water to pass through, but traps waste and debris behind.

A Coanda screen acts by a shearing action referred to as the "Coanda effect," which is discussed below in greater detail. In FIG. 1, the Coanda screen 20 has an upper surface 22, a lower or underside surface 24, a first (upstream) end 26, a second (downstream) end 28, and left and right sides, and is made of a plurality of wedge-shaped wires 30. Additional details of the wires' shape and relative orientation is provided below.

The Coanda screen 20 is mounted at an angle within the upgraded downspout portion 40, with the upstream end 26 of the screen elevated relative to the downstream end 28 of the screen. As shown in FIG. 1, the upgraded downspout portion 40 has four walls—front 46, back 47, left 48, and right 49—and has substantially the same shape and dimensions as the remainder of the downspout. The Coanda screen is affixed within the upgraded downspout portion by, e.g., securing the upstream end 26 of the screen to the back wall 47 of the upgraded downspout portion, and the downstream end 28 of the screen to the front wall 46 of the upgraded downspout portion. So installed, the screen is seen to form an angle θ (theta) with the back wall. In practice, it has been found that best results are achieved when θ has a value of about 15 to 50 degrees, more preferably, about 20 to 45 degrees.

Figure 2A:
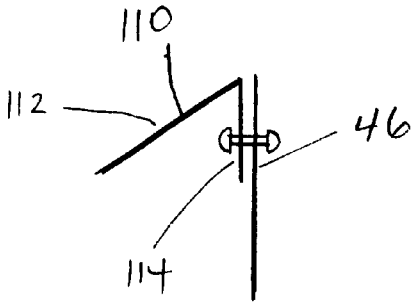
FIG. 2A is a partial cross-sectional view of a deflector plate.

To ensure that a substantial portion of the water entering the downspout is filtered, it is preferred that the screen have a large enough area to make contact with all four walls 46–49 of the interior of the downspout housing. Alternatively (or, in addition), one or more baffles are mounted within the downspout to divert the flow of water toward the screen. In FIG. 1, two baffles 52 and 54 are shown secured to the front wall 46 and side wall 48, respectively, of the upgraded downspout portion at a position above the downspout opening 60, and oriented such that the baffle projects toward the Coanda screen 20. The side baffle 54 comprises a front plate 58 and a rear plate 59. The rear plate 59 is attached to the side wall 48 by known methods, including welding, adhesive, mechanical fasteners and the like while the front plate 58 protrudes from the side wall 48. The front plate 58 protrusion acts as a diverter to divert water that clings to the side wall towards the screen 20. Similar attachment and configuration is discussed below for a deflector plate (FIG. 2A).

Figure 3:
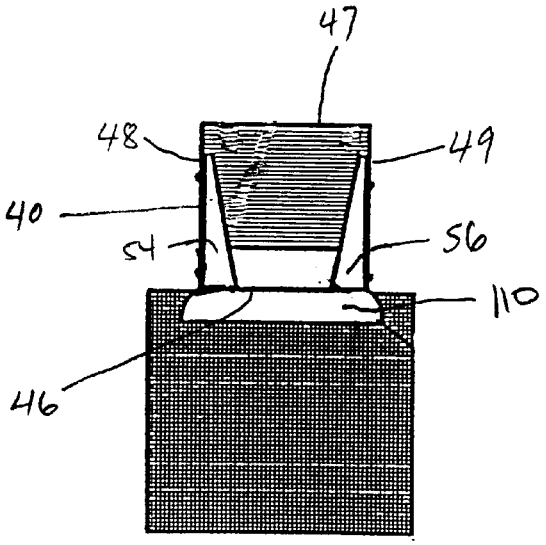
FIG. 3 is a cross-sectional view of the downspout of FIG. 2, taken at line 3—3.
Figure 2:
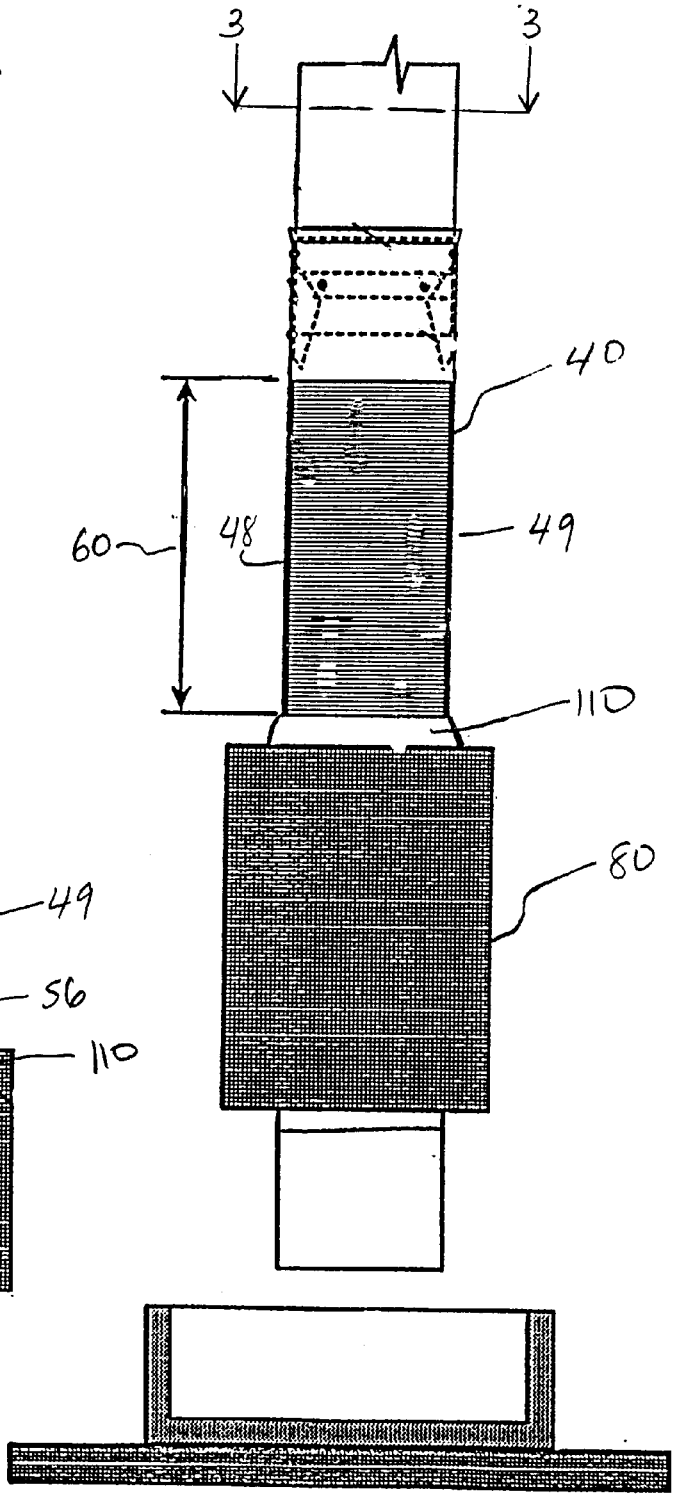
FIG. 2 is a front elevation view of the downspout of FIG. 1.

In FIG. 3, two side baffles 54 and 56 are shown, secured to the left 48 and right 49 side walls of the downspout. Fewer or greater numbers of baffles can be mounted within the downspout to provide optimal diversion of water toward the Coanda screen. For example, the back wall 47 can also be configured to include a baffle. This may be desirable where the upstream end 26 of the screen is not recessed within the surface of the back wall 47. The presence of such a baffle ensures that water cannot bypass the screen. The baffles can be attached to the inside walls of the downspout using any conventional means, including, without limitation, welding, adhesives, and mechanical fasteners.

The downspout opening 60 provides access to the Coanda screen for maintenance and cleaning. Although the screen is self-cleaning, occasionally debris may become trapped within the downspout or (rarely) wedged between the wires 30 that form the screen. Access to the screen is facilitated by providing the downspout opening 60 with appropriate dimensions relative to the screen 20. A preferred downspout opening 60 has a width approximately 50–100% of the interior width of the downspout, and a height approximately 33–75% of the vertical profile of the screen 20, the latter being measured at the wall opposite the downspout opening (the back wall 47 in FIG. 1). The downspout opening 60 is located intermediate the upstream and downstream ends of the downspout 10, but not necessarily equidistant from both ends.

A retaining basket 80 to catch debris caught by the Coanda screen is mounted to the downspout just below a debris deflector plate (further discussed below), using conventional means, such as welding, adhesives, mechanical fasteners, and the like. In an exemplary embodiment, the retaining basket 80 comprises a tightly woven screen made of steel, aluminum, or other weather-resistant material. Debris that does not freely fall into the retaining basket 80 (i.e., debris that clings to the filter due to friction) is eventually pushed out the downspout opening 60 by additional water flowing from the gutter. Water clinging to debris caught in the retaining basket 80 can drip onto the splash guard 100 by passing through the holes of the retaining basket 80. Alternatively, if an underground header is used to connect with the downspout, water that passes through the retaining basket can be caught by a collector (not shown) mounted beneath the retaining basket, and channeled to the header.

In an exemplary embodiment, the downspout is also equipped with an external debris deflector plate 110. The debris deflector plate is mounted just below the downspout opening 60 along the external surface of the front wall 46, just above the retaining basket 80. The debris deflector plate covers any space between the downspout 10 and the retaining basket 80, and ensures that debris exiting the downspout opening does not fall between the downspout and the retaining basket.

In an exemplary embodiment shown in FIG. 2A, the deflector plate 110 includes a front plate section 112 configured to deflect debris into the retaining basket, and a rear plate section 114 configured to be attached to the downspout. In an exemplary embodiment, the deflector plate 110, like the downspout itself, is made of a durable, weather-resistant material, such as aluminum, plastic (e.g., polyvinyl chloride and unplasticized vinyl), galvanized steel, and the like. The deflector plate can be mounted to the downspout by known methods, including welding, adhesives, mechanical fasteners, and so forth.

Figure 4:
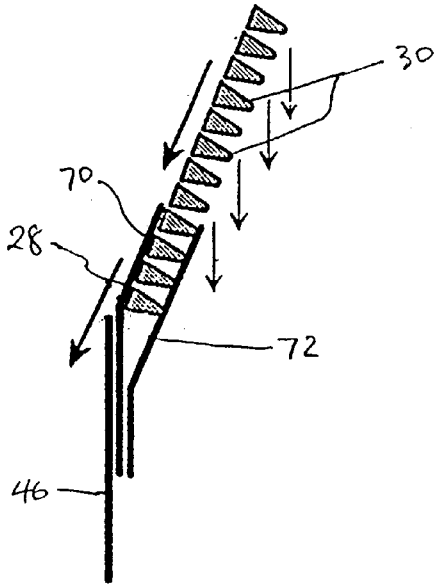
FIG. 4 is an enlarged view of the Coanda screen attached at its downstream end to the downspout.

Reference is now made to FIG. 4, which is an enlarged view of Detail A indicated in FIG. 1. The downstream end 28 of the Coanda screen is shown secured to the downspout front wall 46 by an upper bracket 70 and a lower bracket 72, without obstructing the flow of debris from the upper surface of the Coanda screen into the retaining basket. The two brackets are attached to the downspout by conventional means, such as welding, adhesives, mechanical fasteners, and so forth. Preferably, the upper bracket is substantially flush with the outer wall of the downspout housing at the bottom of the downspout opening.

Figure 5:
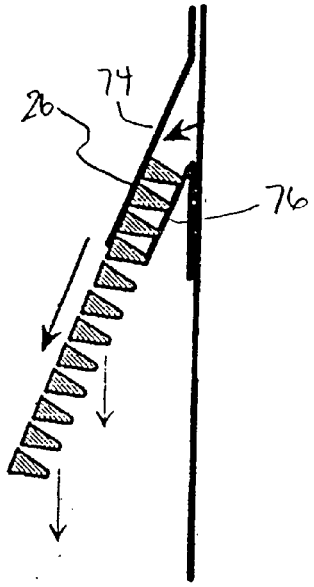
FIG. 5 is another enlarged view of the same Coanda screen attached at its upstream end to the downspout.

Similarly, FIG. 5 provides an enlarged view of Detail B indicated in FIG. 1. The upstream end 26 of the Coanda screen 20 is shown secured to the downspout back wall 47 by upper 74 and lower 76 brackets. However, in addition to securing the upstream end of the screen 20, the upper bracket 74 also serves to divert water flow along the back wall 47 of the downspout to the screen. Although not shown, similar upper brackets may also be mounted around the entire perimeter of the screen so that any water flow along any of the four downspout walls is diverted toward the screen. The two brackets 74, 76 are attached to the downspout by conventional means, such as welding, adhesives, mechanical fasteners, and so forth.

Figure 6:
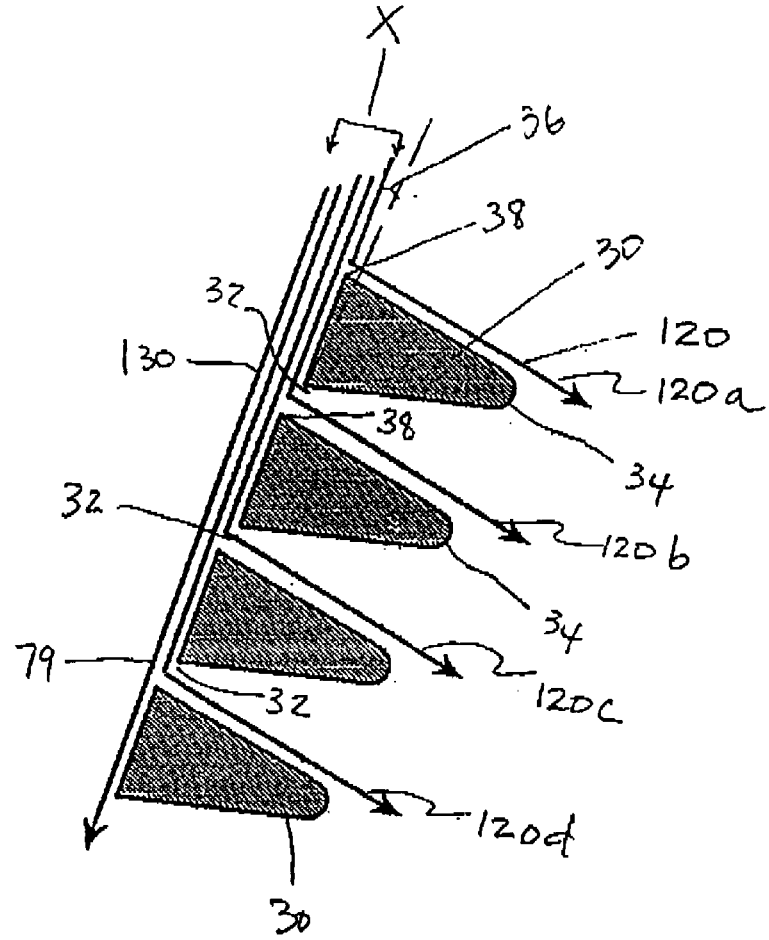
FIG. 6 is an enlarged view of a section of the Coanda screen of FIGS. 4 and 5.
Figure 6A:
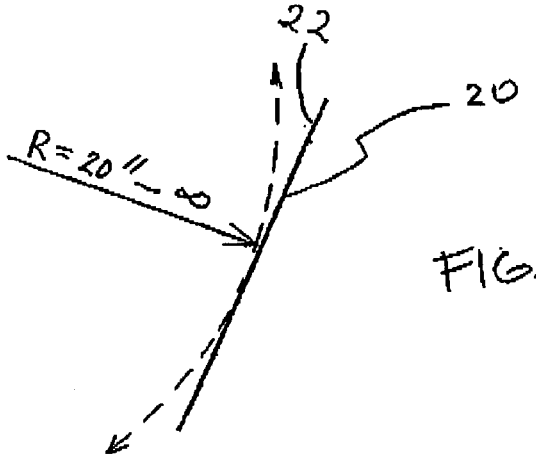
FIG. 6A is a depiction of a concave screen surface.

FIG. 6 shows an exemplary cross-sectional view of the Coanda-effect screen 20. The screen comprises a plurality of individual wedge wires 30, which are parallel to one another and separated from each other by a gap or a spacing 32. The individual wedge wires 30 are held together in the indicated arrangement by welding two or more backer rods (not shown) to the base portions 34 of each individual wedge wire 30. Coanda screens are commercially available in several standard sizes. Generally, the difference in screen selection relates the width, height, and tilt angle 36 of the wedge wires, and the gap spacing 32 between the wedge wires. In addition, the Coanda screen may be ordered with an overall concave shape. As shown in FIG. 6A, the term "concave" implies a curved contour when viewed with respect to the upper surface 22 of the screen 20. When a concave screen is specified, the concave shape has the effect of increasing the tilt angle of the individual wedge wires. This in turn allows the leading (upstream) edge 38 of the wedge wire to shear a greater amount of the water, provided that all other parameters are unchanged. In an exemplary embodiment, the Coanda screen has a gap spacing of about 0.1 to 1.0 mm and a tilt angle of about 3 to 15 degrees, with a radius ("R") of concavity of from about 6 inches to infinity (when R=infinity, the screen is flat). Alternatively, other screen parameters may be used, taking into account the size of the debris likely to be encountered, the anticipated water flow rate and volume, and so forth.

Coanda screens are available from a number of manufacturers and retailers, including on-line retailers such as www.hydroscreen.com, www.johnsonscreens.com, and www.eni.com/norris/default.html. The screen is described in an article entitled "Hydraulic Performance of Coanda-Effect Screens" by Tony Wahl for publication in the Journal of Hydraulic Engineering, Vol. 127, No. 6, June 2001, the entire contents of which are expressly incorporated herein by reference as if set forth in full.

As explained by Wahl, the Coanda effect is a tendency of a fluid jet to remain attached to a solid flow boundary. As shown in FIG. 6, when water 130 flows across the screen 20 from the upstream direction, it tends to remain attached to the upper surface of the screen as it travels in the direction of the downgrade 79. At a given point along the screen, the water has a thickness "X". As water 130 flows down the screen, its thickness X is sheared by the leading edge 38 of each individual wedge wire 30. The sheared water is then redirected approximately tangentially 120 to the direction of the original flow due to the contour of the wedge wire 30. Thus, different wedge wire contour will cause water to be redirected differently. This shearing action is repeated as water traverses down the screen along the direction of the downgrade 79. Water is sheared as it travels over other wedge wires 30. After each layer of water is sheared, it is caused to flow along one of several filtered water paths 120*a*, 120*b*, 120*c*, 120*d*, etc. The thickness of the water stream gets progressively smaller as the downstream end of the screen is approached, and the flow of water appears to slow to a mere trickle, or even drop off altogether.

This phenomenon is used to great effect in the present invention. Debris-laden water is effectively filtered at the Coanda screen. Any debris that does not fall into the retaining basket 80 during rainfall eventually dries on the screen, and either falls into the basket later, or can be manually removed via the downspout opening 60.

Figure 8:
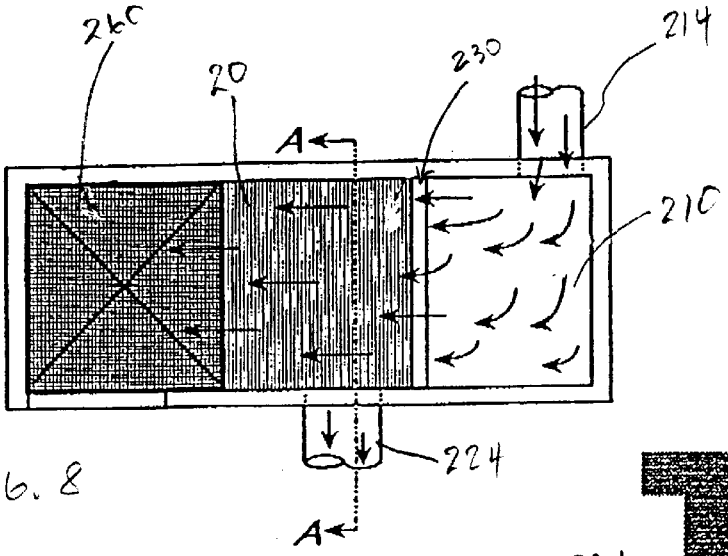
FIG. 8 is a top plan view of the storm drain system of FIG. 7.
Figure 9:
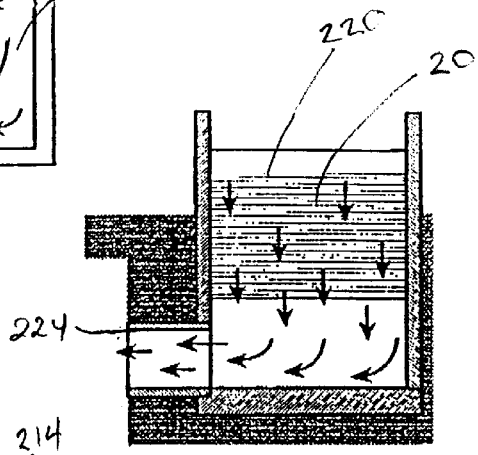
FIG. 9 is a partial cross-sectional view of the storm drain system of FIG. 7 taken at line A—A.
Figure 7:
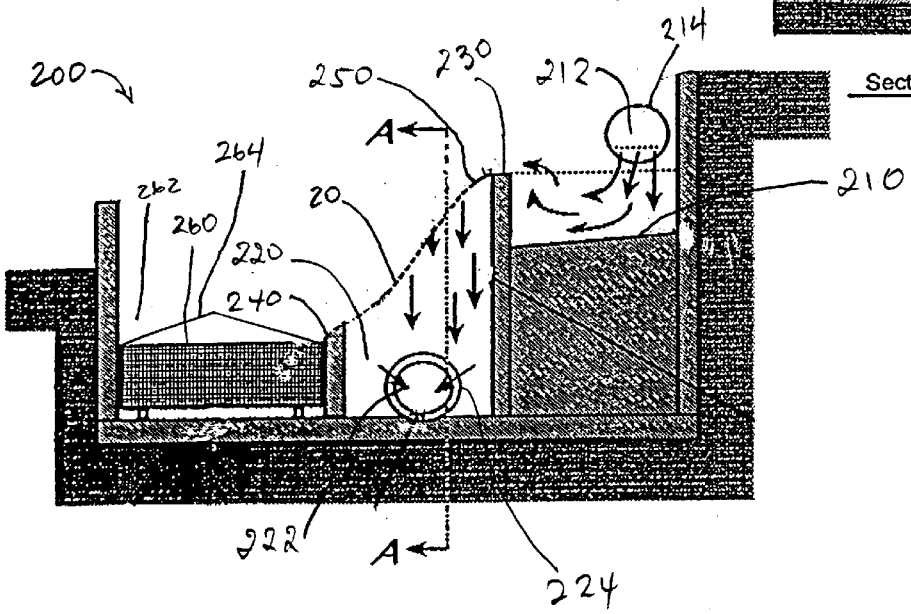
FIG. 7 is a side elevation view of a storm drain system in accordance with practice of the present invention.

In an alternate embodiment of the invention shown in FIGS. 7–9, an effective filter system for removing debris from a storm water runoff collector is provided. The runoff collector 200 comprises a Coanda screen 20 installed between a raw inlet basin 210 and an outlet basin 220. As before, the screen 20 filters incoming water while trapping debris, but the source of water is a raw stream 212, from an inlet 214, and the effluent is a discharge stream 222 for an outlet line 224.

In an exemplary embodiment, the Coanda screen 20 is mounted between a first weir 230 and a second weir 240. The screen has a concave surface, with a radius of from about 6 inches to infinity, and is outfitted with an acceleration plate 250. The acceleration plate 250 is a metal plate of hardened steel, such as stainless steel and the like, mounted to the upstream end 26 of the screen.

The acceleration plate has a width of approximately 2 inches or higher depending on the size of the storm drain system. When water flows from the raw inlet basin 210 over the weir 230, it has a relatively low flow velocity. If water is allowed to flow over the screen 20 without first having the necessary flow velocity, the screen's ability to filter out debris will greatly decrease. The acceleration plate provides a vertical drop of about 2 inches or higher, allowing in-coming water to build up velocity before it contacts the first wedge wire on the screen.

Debris caught by the Coanda screen can slide into a retention basket 260 located within a retention basin 262. In an exemplary embodiment, the retention basket 260 is equipped with a handle 264, which allows the retaining basket to be lifted out of the basin, whereupon the debris can be discarded. The basket 260 may be a conventional basket and may be constructed out of medium to large steel wire mesh. Due to its size, it may be necessary to lift the basket with a crane or a flit truck having a lift.

Figure 10:
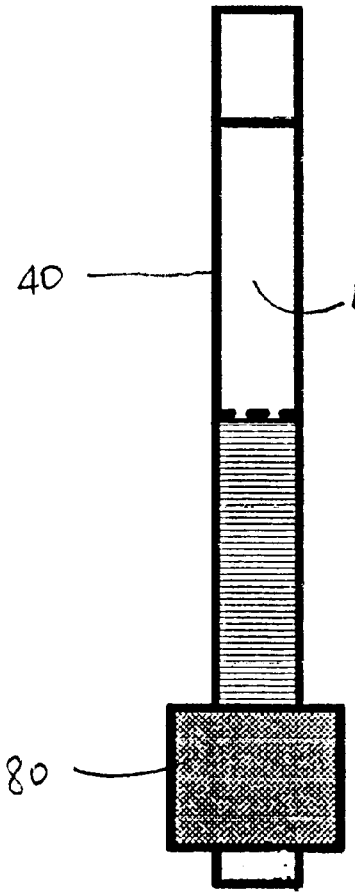
FIG. 10 is a front elevation view of an alternative downspout with a Coanda screen.
Figure 11:
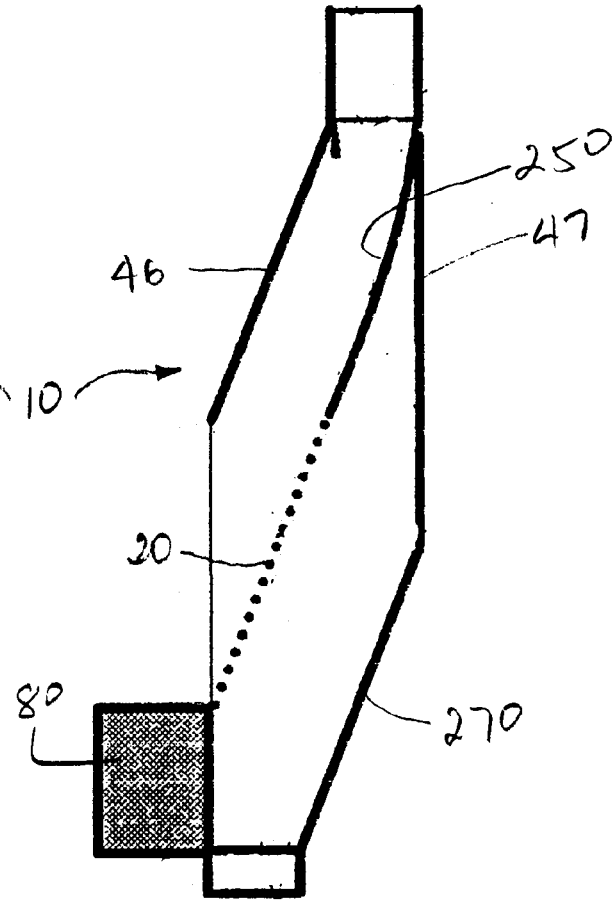
FIG. 11 is a side elevation view of the embodiment of FIG. 10.

In an alternate embodiment of the upgraded downspout 10 shown in FIGS. 10 and 11, a tapered front wall 46 and a modified back wall 47 having a tapered back wall section 270 is provided. The tapered front wall 46 and tapered back wall section 270 allow the screen 20 to be moved forward in the direction of the retaining basket 80, and provide clearance for the installation of an acceleration plate 250. In an exemplary embodiment, additional wall mounted baffles for diverting water toward the screen 20 are not necessary, as the screen is positioned directly below the incoming flow path and even extends past the incoming path. This screen configuration allows all or substantially all of the incoming flow to flow through the screen.

Figures 12, 13:
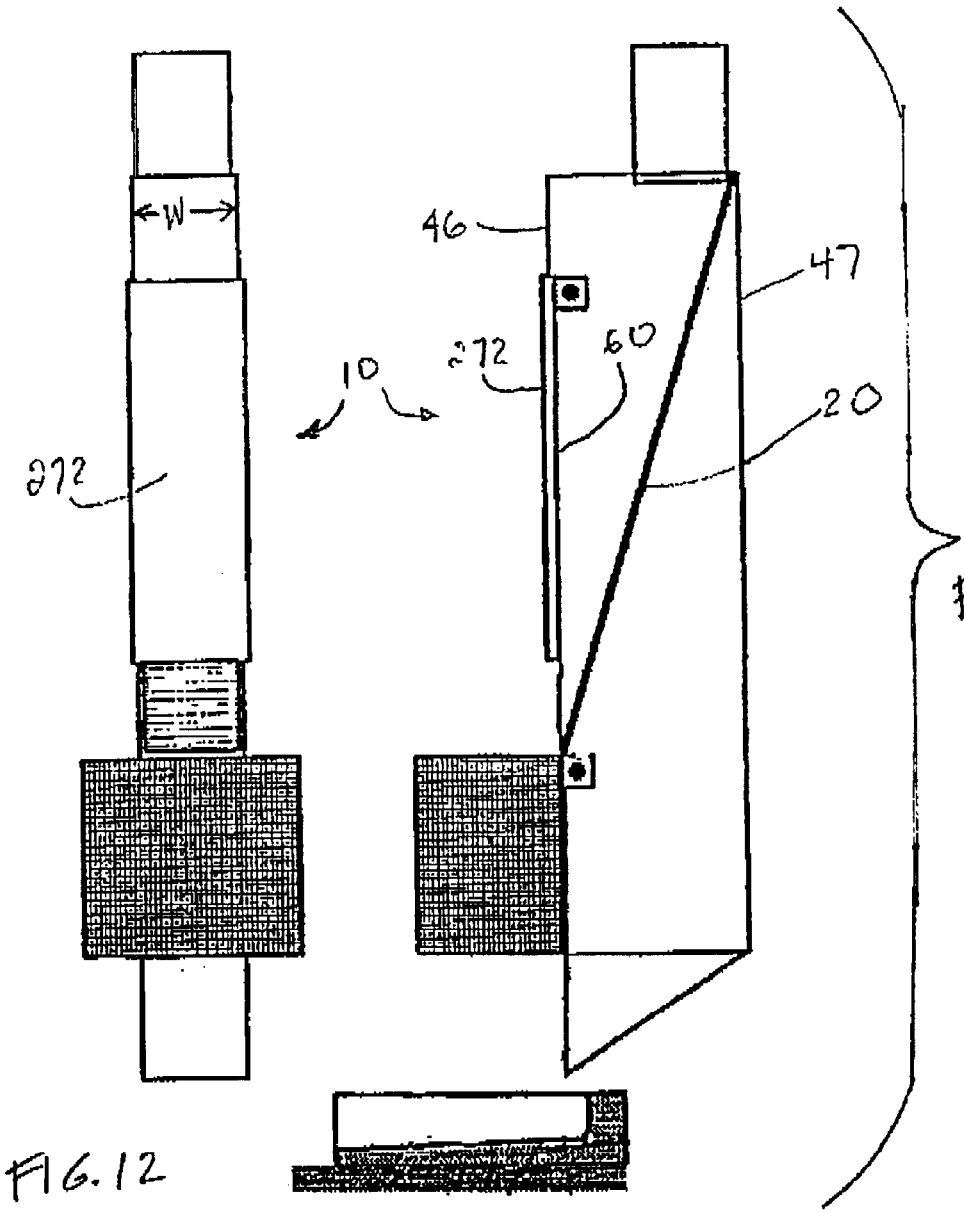
FIG. 12 is a front elevation view of another alternative downspout embodiment with a Coanda screen.
FIG. 13 is a side elevation view of the embodiment of FIG. 12.

In another alternate embodiment of the upgraded downspout 10, shown in FIGS. 12 and 13, an optional hinged cover 272 is provided over the downspout opening 60 of an enlarged upgraded downspout 10. The enlarged upgraded downspout 10 is slightly larger than a conventional or existing downspout section, but has a much larger depth (the distance between the front wall 46 and the back wall 47), e.g., on the order of about 1.3 to 3 times deeper. This allows the enlarged upgraded downspout to accommodate a much larger screen 20 than a standard size upgraded downspout. This in turn, allows the much larger screen 20 to filter substantially all of the incoming flow without the need for wall mounted baffles. However, in the embodiment of FIGS. 10–13, wall mounted baffles, such as baffles 52 and 54, can be used.

Although the invention has been described with reference to preferred and exemplary embodiments, various modifications can be made without departing from the scope of the invention, and all such changes and modifications are intended to be encompassed by the appended claims. For example, an upgraded downspout section can be manufactured as a separate unit and installed as a new downspout. Other materials than those described herein can be used to make the various components of the apparatus described. Changes to the way the baffles are installed, the way they are shaped, the way the deflector plates are installed, and the way the screens are installed within the housing can be made. Other alterations and modifications may be made by those having ordinary skill in the art, without deviating from the true scope of the invention.

What is claimed is:

1. A debris-filtering downspout, comprising:

a downspout having a downspout opening; and a Coanda screen mounted within the downspout and accessible through the downspout opening.

2. A debris-filtering downspout as recited in claim 1, wherein the Coanda screen is mounted at an angle of about 15 to 50° from vertical.

3. A debris-filtering downspout as recited in claim 1, wherein the Coanda screen is mounted at an angle of about 20 to 45° from vertical.

4. A debris-filtering downspout as recited in claim 1, wherein the Coanda screen has a flat profile.

5. A debris-filtering downspout as recited in claim 1, wherein the Coanda screen has a concave profile.

6. A debris-filtering downspout as recited in claim 5, wherein the Coanda screen has a radius of concavity, R, of from about 6 inches to infinity.

7. A debris-filtering downspout as recited in claim 1, wherein the Coanda screen is formed of a plurality of wedge-shaped wires, separated by a gap spacing of about 0.1 to 1.0 mm, with a tilt angle of about 30 to 15°.

8. A debris-filtering downspout as recited in claim 1, wherein the downspout has a rectangular cross-section defined by four walls.

9. A debris-filtering downspout as recited in claim 8, wherein the Coanda screen makes contact with all four walls.

10. A debris-filtering downspout as recited in claim 1, wherein the downspout has a circular cross-section.

11. A debris-filtering downspout as recited in claim 1, further comprising a debris retaining basket mounted outside of and below the downspout opening.

12. A debris-filtering downspout as recited in claim 11, wherein the debris retaining basket is made of mesh.

13. A debris-filtering downspout as recited in claim 12, wherein the mesh is made of a weather-resistant material.

14. A debris-filtering downspout as recited in claim 1, further comprising at least one baffle mounted within the downspout and oriented to direct water flow toward the Coanda screen.

15. A debris-filtering downspout as recited in claim 1, wherein the downspout opening is located intermediate an upstream end and a downstream end of the downspout.

16. An apparatus for upgrading a downspout, comprising:

a downspout section attachable to a portion of an existing downspout, the downspout section having a downspout opening; and a Coanda screen mounted in the downspout section and accessible through the downspout opening.

17. An apparatus as recited in claim 16, wherein the Coanda screen is mounted at an angle of about 15 to 50° from vertical.

18. An apparatus as recited in claim 16, wherein the Coanda screen is mounted at an angle of about 20 to 45° from vertical.

19. An apparatus as recited in claim 16, wherein, the Coanda screen has a flat profile.

20. An apparatus as recited in claim 16, wherein the Coanda screen has a concave profile.

21. An apparatus as recited in claim 16, wherein the Coanda screen is formed of a plurality of wedge-shaped wires, separated by a gap spacing of about 0.1 to 1.0 mm, with a tilt angle of about 3° to 15°.

22. An apparatus as recited in claim 16, wherein the downspout section has a rectangular cross-section defined by four walls.

23. An apparatus as recited in claim 22, wherein the Coanda screen makes contact with all four walls.

24. An apparatus as recited in claim 16, wherein the downspout has a circular cross-section.

25. An apparatus as recited in claim 16, further comprising a debris retaining basket mounted outside of and below the downspout opening.

26. An apparatus as recited in claim 25, wherein the debris retaining basket is made of mesh.

27. An apparatus as recited in claim 26, wherein the mesh is made of a weather-resistant material.

28. An apparatus as recited in claim 16, further comprising at least one baffle mounted within the downspout and oriented to direct water flow toward the Coanda screen.

29. A method for upgrading a downspout to filter debris, comprising:

preparing a first upper downspout section for attaching with an upgraded downspout section; and attaching the upgraded downspout section having a Coanda screen mounted therein and accessible through an opening in said upgraded downspout section with the first upper downspout section.

* * * * *